US005806087A

United States Patent [19]

Grotefend

[11] Patent Number: 5,806,087

[45] Date of Patent: Sep. 15, 1998

[54] SAFETY BELT APPARATUS

[76] Inventor: Michael R. Grotefend, 222 W. Birch St., Hazleton, Pa. 18201-6240

[21] Appl. No.: 906,779

[22] Filed: Aug. 6, 1997

[51] Int. Cl.[6] ..... A41F 9/00

[52] U.S. Cl. ..... 2/1; 2/311; 2/312; 2/338

[58] Field of Search ..... 2/311, 336, 312, 2/338, 1, 3, 4, 318, 319, 321, 322; 182/3; 280/801.1, 290

[56] References Cited

U.S. PATENT DOCUMENTS 3,487,474 1/1970 DeMeo .
3,564,616 2/1971 Battaglia .
3,840,902 10/1974 McNeill .
3,896,499 7/1975 Kelly .
4,028,742 6/1977 Marquis .
4,411,222 10/1983 Wolfson .
4,413,358 11/1983 Jimenez .
5,081,719 1/1992 Donnelly .
5,152,013 10/1992 Johnson .

*Primary Examiner*—Gloria M. Hale
*Attorney, Agent, or Firm*—Anthony J. Dixon

[57] ABSTRACT

A safety apparatus for various size passengers and tandem riders on unenclosed variable speed motorized and non-motorized vehicles which includes a dual belt configuration, a primary belt worn by the driver or front passenger which girds the waist and two (2) secondary belts attached to the primary belt, each having mounted thereon a handle, the position of which is adjustable around the waist in a manner to maintain the secondary belts in equidistant positions comfortably and effectively relative to the middle of the driver or front passenger's back.

4 Claims, 2 Drawing Sheets

SAFETY BELT APPARATUS

BACKGROUND OF THE INVENTION

The present invention relates to the field of safety apparatus, more particularly to apparatus for passengers and tandem riders on unenclosed variable speed motorized and non-motorized vehicles such as motorcycles, waverunners, snowmobiles, all terrain vehicles, rafts, sleds, tows and the like.

In these types of vehicles, it is common for passengers to sit behind the operator of the vehicle and usually secure themselves by holding onto the driver in an arm encircling or hug-like fashion. This type of situation is frought with danger to both the passenger and the driver since it depends solely on the strength and acumen of the passenger to react to different speeds, directions, road, trail or water conditions.

In some circumstances the passenger holds onto the seat or a strap mounted to the seat; however, this affords little improvement over the circumstances cited above.

Further improvements in passenger and driver safety have been set forth in a number of belt-like arrangements for the driver to wear to provide a grip for the passenger to use; however, most of these are limited in their utility due to various designs which merely provide a single belt with handles attached.

It is these problems that the present invention seeks to solve and overcome by providing a novel multi-belt structure which will be described in detail herein.

SUMMARY OF THE INVENTION

The present invention comprises a multi-belt structure wherein a primary belt is worn by the driver which is adjustable to various waist sizes. Mounted to the primary belt are two (2) secondary belts which are attached medially at the rear of the driver's belt, each having a loop handle mounted thereon which can be changed in position along the secondary belt to provide a variety of handle positions for the passenger, more particularly the present apparatus comprises a primary belt which girds the driver's waist and is adjustable as will be described herein. Mounted to the primary belt are two (2) secondary belts which each have mounted to them a loop handle. The secondary belts are slidingly mounted to buckle means on the primary belt so that they can travel along the length of the primary belt thereby adjusting the handle position for a variety of passesngers to utilize.

It is a primary object of the apparatus when in use to provide a safe and reliable hand hold for passengers and tandem riders on unenclosed variable speed motorized and non-motorized vehicles.

It is a further object to provide an apparatus which will enable passengers on such vehicles to maintain balance upon spontaneous directional and speed changes.

It is a further object to provide an apparatus which minimizes the weight shift and movement of the passenger and thereby minimizing disruption of concentration of the operator of the vehicle.

It is a further object to provide an apparatus which enables the passenger to translate adverse motion to the driver to alert the driver to problems or partial loss of the passenger.

It is a further object to provide an apparatus which provides safe, convenient and comfortable handle positions for a variety of passengers and comfortable adjustment for a variety of sizes of drivers.

These and other objects and advantages of the present invention will be made more readily apparent upon review of the drawings and the description of the preferred embodiment which follow.

DESCRIPTION OF THE PREFERRED EMBODIMENT

Figure 1:
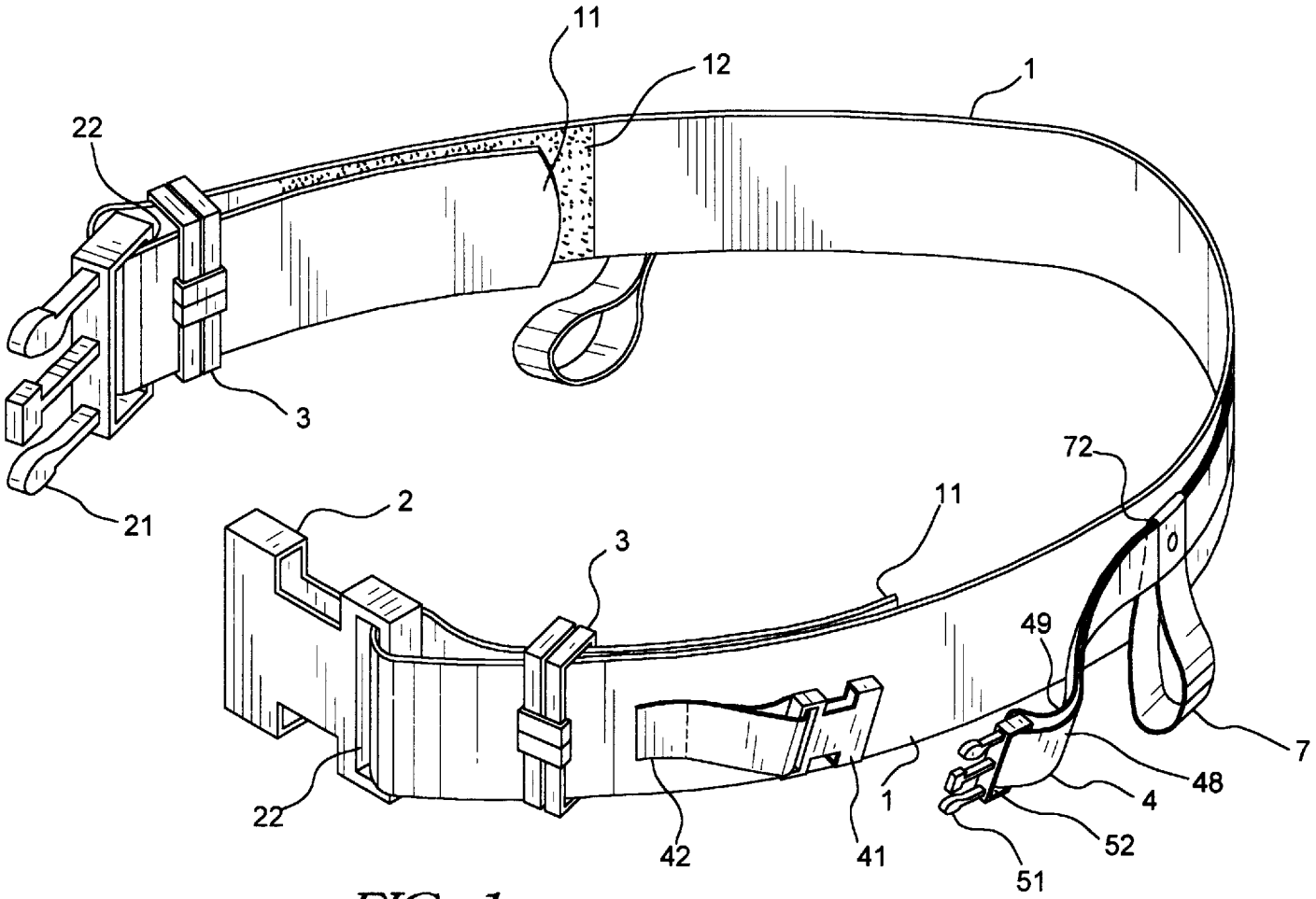
FIG. 1 is a side view of the present invention.

Referring to FIG. 1, a side perspective view of the present invention can be seen. The primary belt 1, is designed to gird or encircle the waist of the driver of the vehicle. At each end, the belt forms a loop which is folded back over itself. The end of the belt passes through slot, 22, in male buckle, 21, and through a similar slot, 22, in female buckle, 2. The primary belt loops, 3, encircle the body of the belt adjacent to each buckle. The end of the belt passes back through the belt loop, 3, and doubles on itself to allow for shortening on each end by drawing male belt, 1, through slot, 22, and back through loop, 3. Attached to the inner surface of belt, 1, at location, 11, is a hook-loop fastener or Velcro fastener or the like to provide a connection of the belt, 1, to itself so that the end of the belt, 1, are flat and comfortable against the body of the driver.

The buckle system, 2-21, is of a squeeze release type commercially available. Naturally, other buckle means are useable so long as the slots, 22, are provided to allow for girth adjustment.

Figure 2:
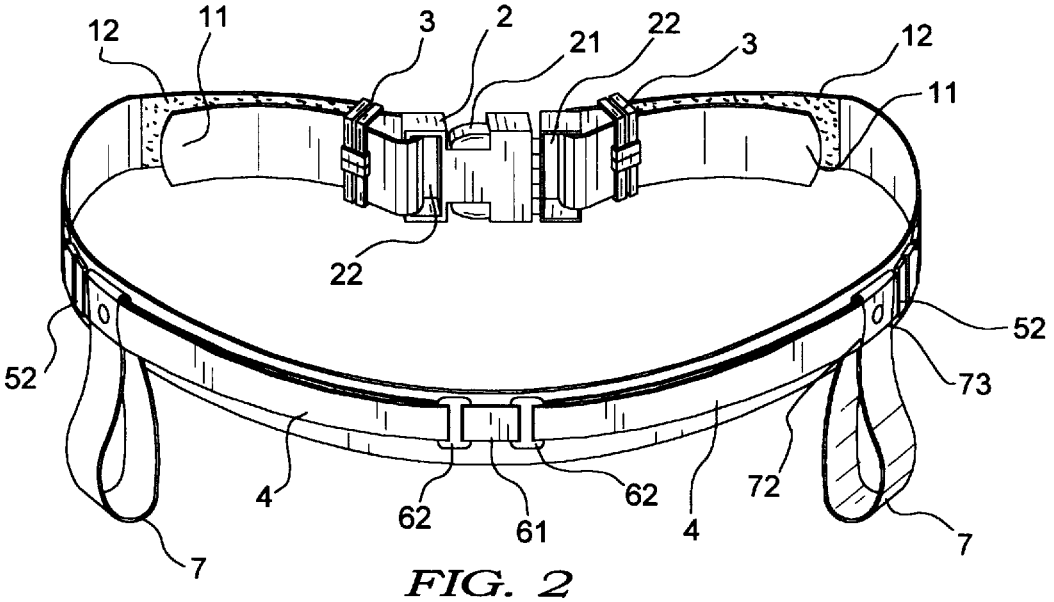
FIG. 2 is a back view of the present invention.
Figure 3:
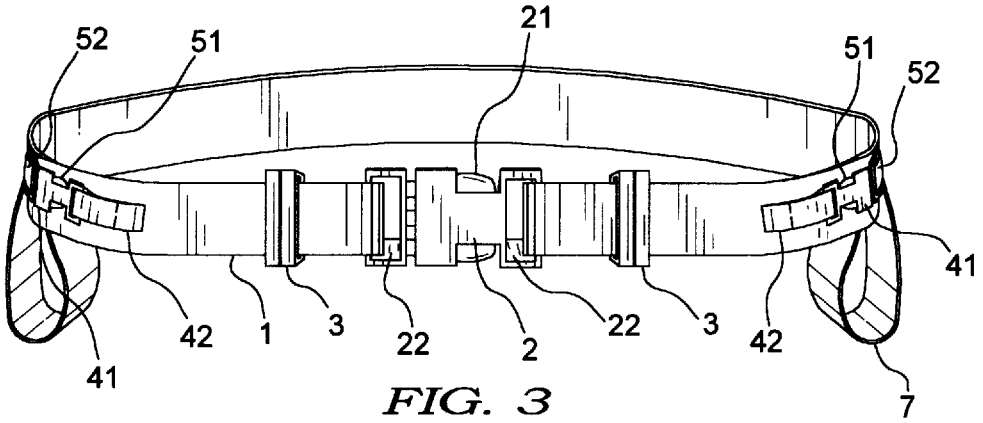
FIG. 3 is a front view of the present invention.

The secondary belts, 4, which are two (2) in number, are identical to each other and are mounted on the outside of primary belt, 1. See FIGS. 1 and 2. Each secondary belt is a loop configuration which passes through a slot, 52, in the male buckle, 51 and a slot, 62, in the rear attachment at 61, thereby forming a collapsed circular configuration with an outer half, 48, and an inner half, 49. This allows the secondary belt, 4, to slide. The handle, 7, is a double loop configuration. The first loop, 7, is the loop through which the user's hand holds onto the apparatus. The second inner loop, 72, is accommodatingly larger than the secondary belt, 4. The handle, 7, is fixedly attached to the outer half, 48, of the Secondary belt, 4. As the secondary belt then passes through slot, 52, back along itself through inner loop, 72, of handle, 7, and through slot, 62, to complete its circular configuration, the handle then can be moved to various locations by sliding belt, 4, through slots, 52 and 62.

The secondary belt buckle, 51, is then inserted into a receiving or female end, 41, which is fixedly attached to the primary belt, 1. This buckle arrangement on the secondary belt locks handle, 7, position and also allows the user to open the buckle and thereby relieve tension on the secondary belt to allow the handle position to be conveniently reset. When the buckle is reconnected, the secondary belt, 4, lies firmly against the outside of the primary belt, 1, to assist in maintaining a sleek silouette to the entire device. This sets the position of handles, 7, relative to primary belt, 1.

It is anticipated that the entire belt be constructed of a canvas webbing material or the like to provide resistance to weather conditions when used on the road or to withstand soaking in water when used on a water vehicle. The apparatus requires no modification to be used in either wet or dry environments.

In use, the primary belt is girded around the waist of the driver of the vehicle and the length is adjusted by drawing the belt end, 11, through belt loops, 3, slots, 22, from sequentially outside inwardly and then back through belt loop, 3. By adjusting each side, the fixed connection, 61, remains in a central position at the middle of the back of the driver and the secondary belts, 4, remain equidistant from the middle of the back of the driver. Each end, 11, is then secured to the inside of belt, 1, by Velcro or the like which is on the opposing face of belt, 1, and ends , 11. This is shown at number 12 in the Figure. Once this adjustment is made, the handle, 7, adjustments can be made. Each can be individually positioned at any location between medial connection, 61 and secondary belt buckle, 52. Each secondary belt is a continuous loop which passes sequentially through slot, 62, fixed to the primary belt loop, 72, slot, 52, at the buckle, 41-51 location. Adjacent to loop, 72, belt, 4, is fixed to handle, 7. As a result, sliding belt, 4, in its circular path, changes the location of handle, 7, relative to belt, 1. When the desired position is achieved, the buckle, 41-51, is fastened and the position is set. The rearward force on handle, 7, caused by the passenger holding on, is translated via secondary belt, 4, and its fixed connections, 42 and 61, to the primary belt, 1, and thereby to the waist of the driver wearing the apparatus. This rearward force and the natural friction caused by secondary belt, 4, within slots, 52 and 62, now fixes the handle in the same relative position. To change this position, the secondary belt buckle, 41-51, is opened and the slackness thereby caused in belt, 4, allows for simple position adjustment of handle, 7.

Naturally, modifications and variations of this apparatus are apparent in light of the teaching of the present invention and it is therefore understood that these modifications are deemed to be within the scope of the claims appended hereto.

I claim:

1. A safety belt apparatus for passengers on non-enclosed vehicles such as motorcycles, bicycles, snowmobiles, waverunners and the like comprising:

a. a first belt, within inner surface and an outer surface adapted to gird the waist of the driver;

b. a fixed connection mounted on the first belt at a location adjacent to the middle of the back of the wearer;

c. means for adjusting the size of the first belt so that the medial connection maintains its position relative to the back of the wearer;

d. a pair of oppositely directed slotted members fixedly attached to the medial connection;

e. two (2) secondary belts each forming a continuous loop which passes through one of the slotted members;

f. a buckle with a first and second half, the first half mounted fixedly on the first belt at a location between the medial connection and means, c, and the second half mounted slidingly on the secondary belt;

g. a pair of handles mounted to the secondary belt, each handle comprising a first loop to accommodate the hand of the passenger and a second loop through which the secondary belt can slide;

wherein the primary belt is girded to the driver and the two (2) handles are positioned along the secondary belt in an adjustable position to accommodate the passenger.

2. The safety belt apparatus of claim 1 wherein the means for adjusting the size of the first belt comprises a buckle with a male end and a female end, each end slidingly mounted on the first belt and each end having a slot defined therein whereby one end of the first belt can be drawn through each slot and back on itself to provide an independent length adjustment to each end of the first belt.

3. The safety belt of claim 2 wherein each end of the first belt is passed through the slot and reattached to itself.

4. The safety belt of claim 3 wherein each end of the first belt is attached to itself by a hook-pile fastener mounted on the inner surface of the first belt.

* * * * *